US007266421B1

(12) United States Patent
Blayrac et al.

(10) Patent No.: US 7,266,421 B1
(45) Date of Patent: Sep. 4, 2007

(54) SYSTEM FOR CONTROLLING LIFTING AND REMOTE HANDLING UNITS LOCATED IN A CONFINED ENCLOSURE

(75) Inventors: Michel Blayrac, Villenueve le Avignon (FR); Gilles Polydor, Roqueuaune (FR); André Sault, Saint-Nazaire (FR); Michel Martin, Bagnols fu Ceje (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/831,084

(22) PCT Filed: Nov. 8, 1999

(86) PCT No.: PCT/FR99/02723

§ 371 (c)(1),
(2), (4) Date: May 3, 2001

(87) PCT Pub. No.: WO00/28550

PCT Pub. Date: May 18, 2000

(30) Foreign Application Priority Data

Nov. 10, 1998 (FR) ..... 98 14141

(51) Int. Cl.
*G07F 7/00* (2006.01)

(52) U.S. Cl. ..... 700/217; 700/218

(58) Field of Classification Search ..... 700/217, 700/218; 414/146; 165/11.2; 901/49
See application file for complete search history.

(56) References Cited

U.S. PATENT DOCUMENTS 3,953,935 A * 5/1976 Reiner et al. ..... 446/26
4,046,262 A * 9/1977 Vykukal et al. ..... 414/5
4,194,634 A * 3/1980 Kelly ..... 209/589
4,380,880 A * 4/1983 Gandy ..... 40/564
4,631,404 A * 12/1986 Burkhardt et al. ..... 250/237 G
4,638,234 A * 1/1987 Schroder et al. ..... 318/661
4,709,265 A * 11/1987 Silverman et al. ..... 348/158
4,736,826 A * 4/1988 White et al. ..... 191/12.2 A
4,786,810 A * 11/1988 Shulman et al. ..... 250/370.01

(Continued)

FOREIGN PATENT DOCUMENTS

DE 39 30 945 A 3/1991

(Continued)

OTHER PUBLICATIONS

Abstracts of Japan, vol. 098, No. 008, Jun. 30, 1998 for Publ. No. 10072117, 1 page, incomplete document abstract only.

*Primary Examiner*—Patrick Mackey
*Assistant Examiner*—Michael Butler
(74) *Attorney, Agent, or Firm*—Pearne & Gordon LLP

(57) ABSTRACT

The control system is used to control manipulation equipment (41) and carrying equipment (43) confined in a containment (40) inaccessible to operators and to perform maintenance operations related to electronic circuits for onboard equipment enclosed in the containment (40).

Control is achieved by "onboard" means in the containment (40) composed mainly of a power supply box (1) and one or several control boxes (20) fixed onto a base (44) placed permanently on the carrying equipment (43) of the manipulation equipment (41). Several power supply circuits and electronic control boards are provided to enable redundant operation.

Application to remote manipulation equipment used for dismantling and reprocessing of contaminated equipment.

9 Claims, 4 Drawing Sheets

U.S. PATENT DOCUMENTS 4,932,831 A * 6/1990 White et al. ..... 414/732
4,977,329 A * 12/1990 Eckhardt et al. ..... 250/551
5,017,329 A * 5/1991 Vermaat ..... 376/249
5,037,602 A * 8/1991 Dabiri et al. ..... 376/198
5,088,610 A * 2/1992 Garnier ..... 212/196
5,158,739 A * 10/1992 Gente et al. ..... 376/260
5,170,032 A * 12/1992 Lemelson ..... 219/121.15
5,193,685 A * 3/1993 Trevithick ..... 209/3.1
5,194,215 A * 3/1993 Nachbar et al. ..... 376/249
5,287,272 A * 2/1994 Rutenberg et al. ..... 382/224
5,294,826 A * 3/1994 Marcantonio et al. ..... 257/659
5,324,948 A * 6/1994 Dudar et al. ..... 250/379
5,442,179 A * 8/1995 Ohishi ..... 250/363.02
5,444,254 A * 8/1995 Thomson ..... 250/370.07
5,570,992 A * 11/1996 Lemelson ..... 414/744.3
5,745,545 A * 4/1998 Hughes ..... 378/65
5,779,609 A * 7/1998 Cullen et al. ..... 483/69
5,801,387 A * 9/1998 Nablo et al. ..... 250/492.3
5,887,041 A * 3/1999 Zachar et al. ..... 376/248
5,969,569 A * 10/1999 Marceau et al. ..... 327/574
6,055,295 A * 4/2000 Murthy et al. ..... 378/151
6,068,073 A * 5/2000 Roston et al. ..... 180/8.5
6,098,637 A * 8/2000 Parke ..... 134/1.1
6,105,695 A * 8/2000 Bar-Cohen et al. ..... 180/8.5
6,113,343 A * 9/2000 Goldenberg et al. ..... 414/729
6,275,747 B1 * 8/2001 Wada et al. ..... 700/266
6,355,878 B1 * 3/2002 Kim ..... 174/35 GC
6,390,672 B1 * 5/2002 Vail et al. ..... 374/170
6,530,847 B1 * 3/2003 Antonious ..... 473/327
6,812,476 B1 * 11/2004 Alexandre ..... 250/515.1
6,870,343 B2 * 3/2005 Borenstein et al. .... 318/568.16
6,925,815 B2 * 8/2005 Shafer ..... 62/51.1
2002/0094257 A1 * 7/2002 Babbs et al. ..... 414/277

FOREIGN PATENT DOCUMENTS

EP 0 100 684 A 2/1984
EP 0 461 982 A 12/1991
JP 04-4027657 A * 12/1984
JP 04-050073 A * 2/1992
JP 04-066364 A * 3/1992
WO WO99/49785 A1 * 10/1999

* cited by examiner

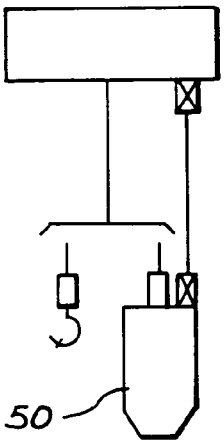
FIG. 4 A
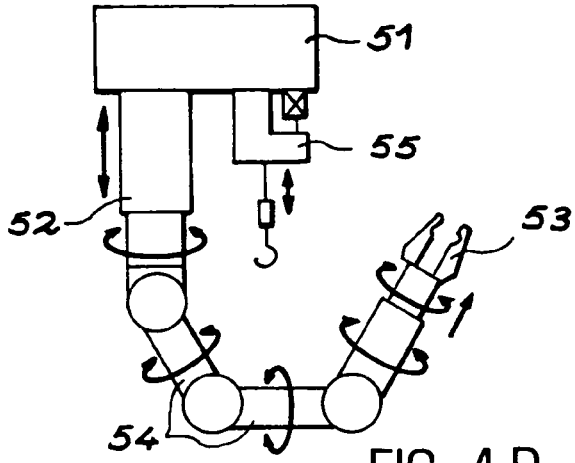
FIG. 4 B
FIG. 4 C
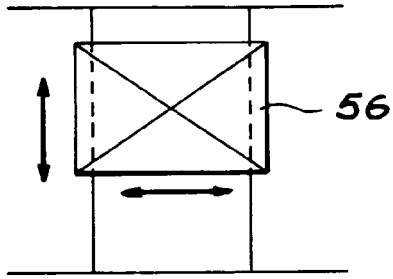
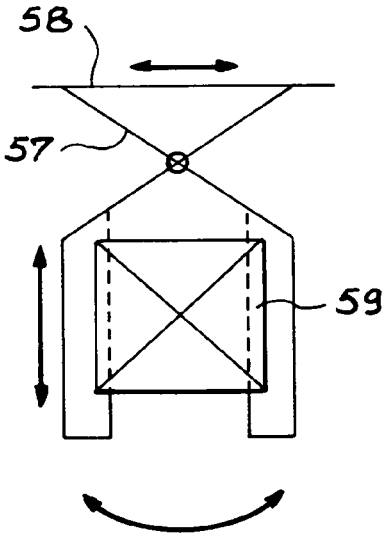
FIG. 4 D
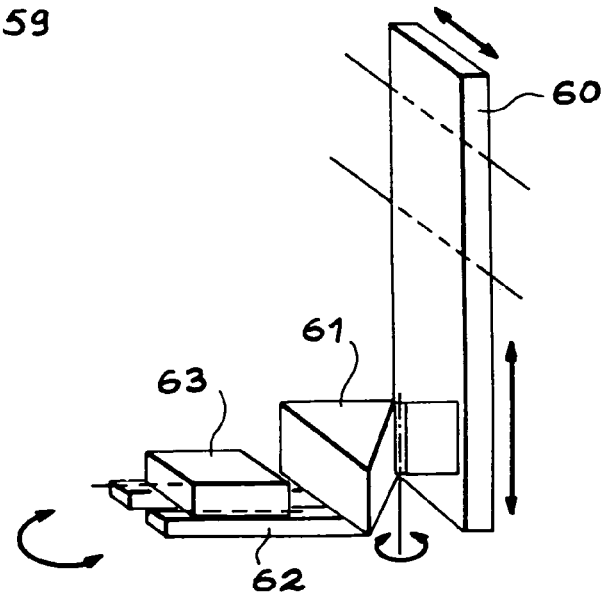
FIG. 4 E

SYSTEM FOR CONTROLLING LIFTING AND REMOTE HANDLING UNITS LOCATED IN A CONFINED ENCLOSURE

FIELD OF THE INVENTION

The invention is related to the nuclear fuel reprocessing industry and reprocessing of contaminated equipment.

In particular, it is applicable to remote manipulators placed in confined containments inaccessible to man in order to perform a number of tasks in these containments.

PRIOR ART AND PROBLEMS THAT ARISE

Remote manipulation equipment has been used in installations related to the nuclear industry, to reduce the exposure of workers to radiation and to facilitate execution of some tasks that would be difficult or even impossible to carry out otherwise. Equipment has been perfected over the years particularly due to progress with electronics and particularly in data processing and optical/visual techniques, and materials technology. Among other progress, this has boosted the robotics industry since robots are widely used in the nuclear industry in which there are particular dangers such as radiation, in confined working areas sometimes with particularly high temperatures or humidity.

Fuel reprocessing services that receive fuel confined in casks, and then carry out various mechanical processing (open cases, shearing) and chemical processing (dissolution, clarification, adjustment). Remote manipulation equipment installed in these confined areas is inaccessible to man and introduces a control problem. The system used frequently consists of remote transmission equipment using a carrier current. In other words, control orders are sent through the power supply line to frequency modulation equipment. Control is achieved by a man using equipment located outside the cell (called ground equipment) and equipment located inside the cell (called onboard equipment).

The various equipment and robots used in these confined containments frequently consist of a combination of a carrier system and a manipulator. Thus, lifting equipment, heavy remote manipulators, travelling cranes, wall brackets and wall slides are used.

FIG. 4A shows lifting equipment which enables horizontal movements in the two perpendicular directions, X and Y, depending on the type of carrier on which it is installed. It is provided with a winch that raises and lowers an electronic grab 50.

FIG. 4B shows a heavy duty remote manipulator in which the body 51 may be placed anywhere inside the containment, depending on the carrier used, and enables movements in perpendicular horizontal directions X and Y, and a rotation about a vertical axis of a main arm 52 that it supports. A grip 53 is placed at the end of this arm, which is also capable of rotating about an axis carried by the arm 52 through intermediate arms 54. These intermediate arms may also be provided with rotation movements. The assembly is also completed by a pulley block 55 fixed to the bracket 51.

All this equipment have a degree of movement that depends on the carrying equipment used. For example, FIG. 4C shows a bottom view of a travelling crane together with a plate enabling a carriage 56 to move in two horizontal directions X and Y.

FIG. 4D is a top view showing a wall bracket provided with a triangulated frame 57 free to move along a horizontal rail and fixed to a vertical wall 58 of the containment. Horizontal translation is possible along this wall 58 in the X direction. Furthermore, this triangulated structure enables horizontal movement of a plate 59 that it supports, along the perpendicular Y direction.

FIG. 4E shows a wall slide. This wall slide is provided with a base 60 that can be moved vertically along the Z direction and along a horizontal X direction with respect to the containment wall. A bracket crane 61 is mounted free to move in rotation about a vertical axis fixed to the base 60. This bracket 61 supports a plate 63 on two horizontal rails 62, such that the plate 63 can therefore move horizontally along these two rails.

In all cases, it is essential to be able to easily and quickly perform servicing and maintenance of onboard equipment in the confined cells. The onboard electronic equipment can fail; in any case, its life is such that it will have to be renewed. In particular, the electronic boards will need to be replaced regularly. Consequently, the defective equipment needs to be physically retrieved and human action is necessary in intermediate areas or maintenance locks, or work corridors, in which operators will need to work for several minutes or several hours depending on difficulties encountered during the repair.

Furthermore, an electronic board cannot be repaired unless it is taken out of the confinement containment. But, like all other equipment located in the containment, this electronic board is contaminated. Therefore, it has to undergo a decontamination treatment before it can be repaired. However, decontamination treatment is aggressive and can degrade its components, or cause general deterioration of the board.

Furthermore in order to resist radiation, electronic boards are made using hardened techniques. Therefore they are expensive. Furthermore, it is becoming more and more difficult to procure them, so that operators often need to repair boards by tinkering with them rather than changing them.

Therefore, the main purpose of the invention is to facilitate maintenance of onboard equipment inside confined containments by modifying the onboard control system and the ground system to minimise human action and the times necessary for these actions.

SUMMARY OF THE INVENTION

Consequently, the main purpose of the invention is a control system for remote manipulation equipment operating in a confinement containment and subjected to radioactive radiation comprising:

"onboard" control means located inside the containment designed to control movements of the said remote manipulation equipment, and management means located outside the containment providing the interface between the operator and the control means.

According to the invention, control means comprise firstly a control box impermeable to radiation and comprising electronic circuit boards, and secondly a power supply box impermeable to radiation and comprising at least one energy supply source, and management means comprise a communication device to transmit orders to onboard control means and to receive data about the state of the said control means and the state of remote manipulation equipment.

In its preferred embodiment, the power supply box comprises two power supply sources operating redundantly.

The electronic circuit boards preferably comprise several microprocessors operating alternately and processing circuits providing functional control over these microprocessors.

The control system according to the invention is advantageously self-configurable.

In their preferred embodiment, the control means comprise circuits for processing status data emitted by control means to diagnose failures and operating errors of the equipment and control means.

It is planned that the control means should each be provided with a base, larger than the power supply box and the control box, fixed permanently on each equipment to be controlled and each being provided with:

- means of attachment to a control or power supply box onto a base;
- internal connection means to make electrical and/or electronic connections between the box and the base on which it is fixed; and
- external connection means for making electrical and/or electronic connections between the equipment to be controlled and the base.

In this case, it is also planned that the power supply boxes and the control boxes should be provided with locking means on their bases, that can be manoeuvred from outside these power supply and control boxes.

The base of each control box is preferably provided with a lead base plate underneath it to protect it against the harmful effect of radiation.

In their main embodiment, the power supply and control boxes each comprise a stainless steel housing closed by a Plexiglas cover.

Finally, this type of assembly is advantageously closed with gaskets.

BRIEF DESCRIPTION OF THE DRAWINGS

The invention and its main technical characteristics will be better understood after reading the following description together with the eight attached figures describing:

FIGS. 4A, 4B, 4C, 4D, 4E, showing diagrams for instruments located inside the containments and on which elements of the system according to the invention are to be installed.

DETAILED DESCRIPTION OF AN EMBODIMENT OF THE INVENTION

Figure 1:
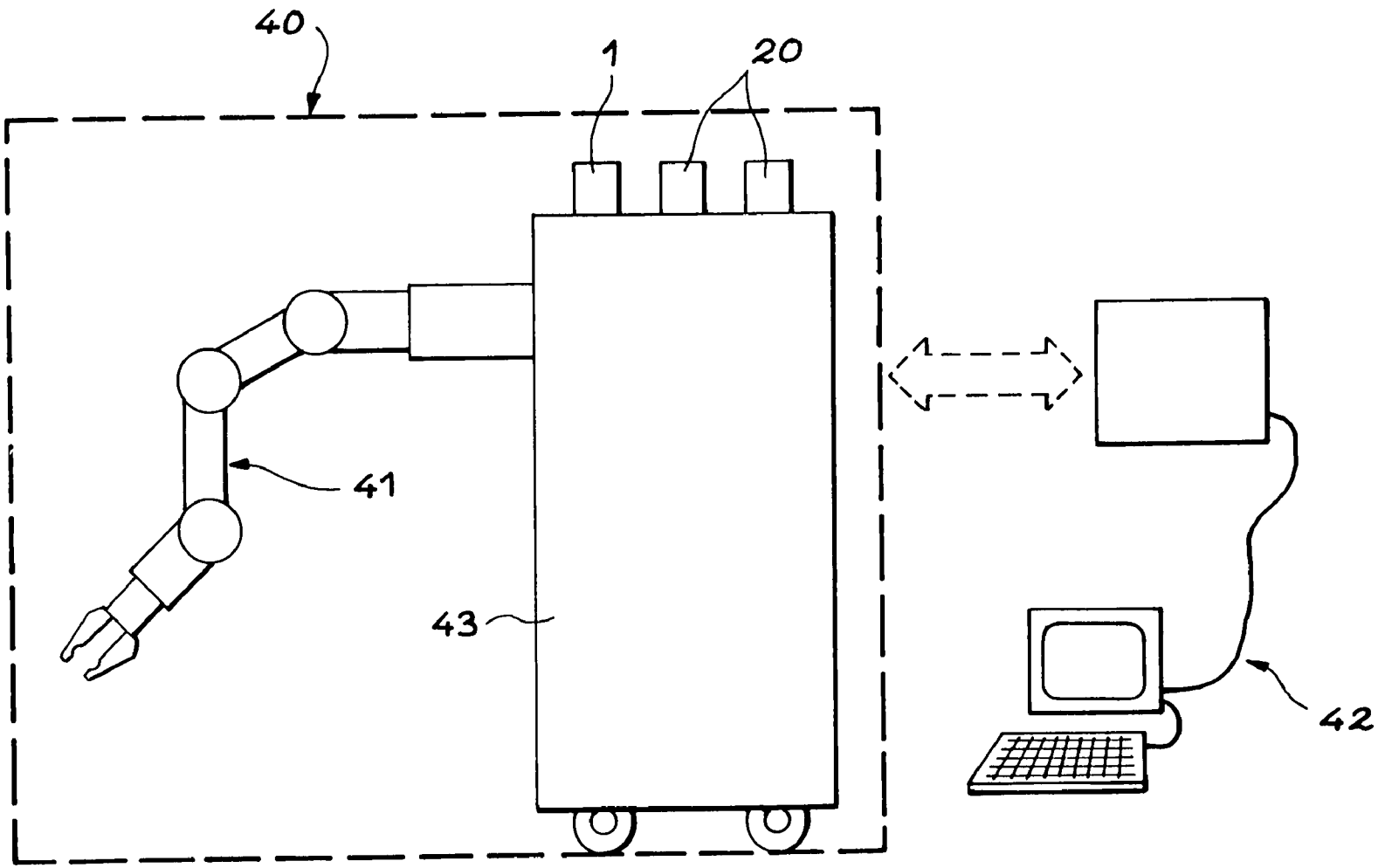
FIG. 1, the control system according to the invention within the context of its use.

The system according to the invention, shown diagrammatically in FIG. 1 comprises firstly onboard control means 43 in the equipment 41 to be controlled, and secondly "ground" control means 42, in other words control means located outside the confinement containment 40 in which the equipment to be controlled 41 is located. Information is transmitted between ground equipment and onboard equipment using the known carrier currents technique (that consists of superposing a high frequency signal on the power frequency current supplying power to the equipment, modulated by a low frequency signal representing the logical signal to be transmitted).

Each equipment 41 located in a confined containment 40 comprises a frame/cabinet 43 that supports control means consisting of a base 44 on which one or several boxes can be fitted, and in particular a power supply box 1 and one or several control boxes 20.

The power supply box 1 contains all power supply sources necessary for transmission of information to the ground equipment. According to the preferred embodiment of the invention, this power supply box 1 comprises two redundant 24/48 Volt power supply sources that are capable of replacing each other if one becomes defective.

The control box 20 comprises all elements necessary for control of equipment 41 to which it is fixed. Preferably, these elements necessary for control of equipment 41 are distributed in several control boxes 20 electrically connected to each other through a base 44 which will be described in more detail later.

Advantageously, the control boxes 20 are distributed as follows:

- an onboard remote transmission box that contains the equipment that will manage the link with the ground equipment, and thus transfer information from the onboard equipment to the ground equipment;
- an onboard data processing box that contains electronic circuit boards, these electronic boards determining movements to be made by the equipment based on information received from the ground equipment and local information supplied by equipment sensors.

According to one preferred embodiment of the invention, this onboard data processing box contains two CPU (Central Processing Unit) boards each comprising two microprocessors, two FSK boards (Frequency Shift Modulation), two on-off type input/output boards and an encoder board. In this embodiment, the four microprocessors in the data processing box operate alternately. These microprocessors operate in turn in order to increase their life, and the capacities of each (see French patent application FR-2 663 160). Onboard software in the same box manages these four microprocessors.

Note that the data processing box according to the invention is the same regardless of the type of equipment to be controlled (lifting equipment, heavy duty remote manipulator, etc.).

- an onboard power box that forms the interface between the onboard data processing box and the various mechanical equipment movement means (motors, clutches, etc.). This power box is provided with several relays controlled by outputs from the data processing box. These relays change over the power supply to the mechanical equipment movement means;
- a power supply box for the data processing box.

Apart from control means, each equipment is provided with status sensors such as encoders and limit switch sensors, that provide information to control means about the exact position of the equipment within the confined containment.

The control means that were described above are managed on the ground by control means 42. These control means consist of a general cell cabinet that contains:

- a ground remote transmission device intended to control the link with onboard control means therefore to transfer information from the ground equipment to the onboard equipment;
- a mobile control box that the operator can use to control equipment movements on the ground, and become aware of the state of this equipment;

a host industrial PC type computer that manages all ground equipment and onboard equipment.

Advantageously, diagnostic assistance software is installed on the host computer to identify operating errors and/or failures of the equipment located in the confined containment. For example, if one of the microprocessors in the onboard data processing box is not working correctly, the software orders that this microprocessor should be put to "rest" and the system continues to operate on the remaining three microprocessors. The defective microprocessor is regenerated during this rest time.

Preferably, the host computer memorises all system statuses in a file that can be viewed in real time.

According to one embodiment of the invention, the host computer operating system is an IRMX® real time system and the control and diagnostic assistance software is written in the BORLAND C/C++ language.

A man/machine interface is made using a keyboard and a screen connected to the main cabinet.

Figure 2:
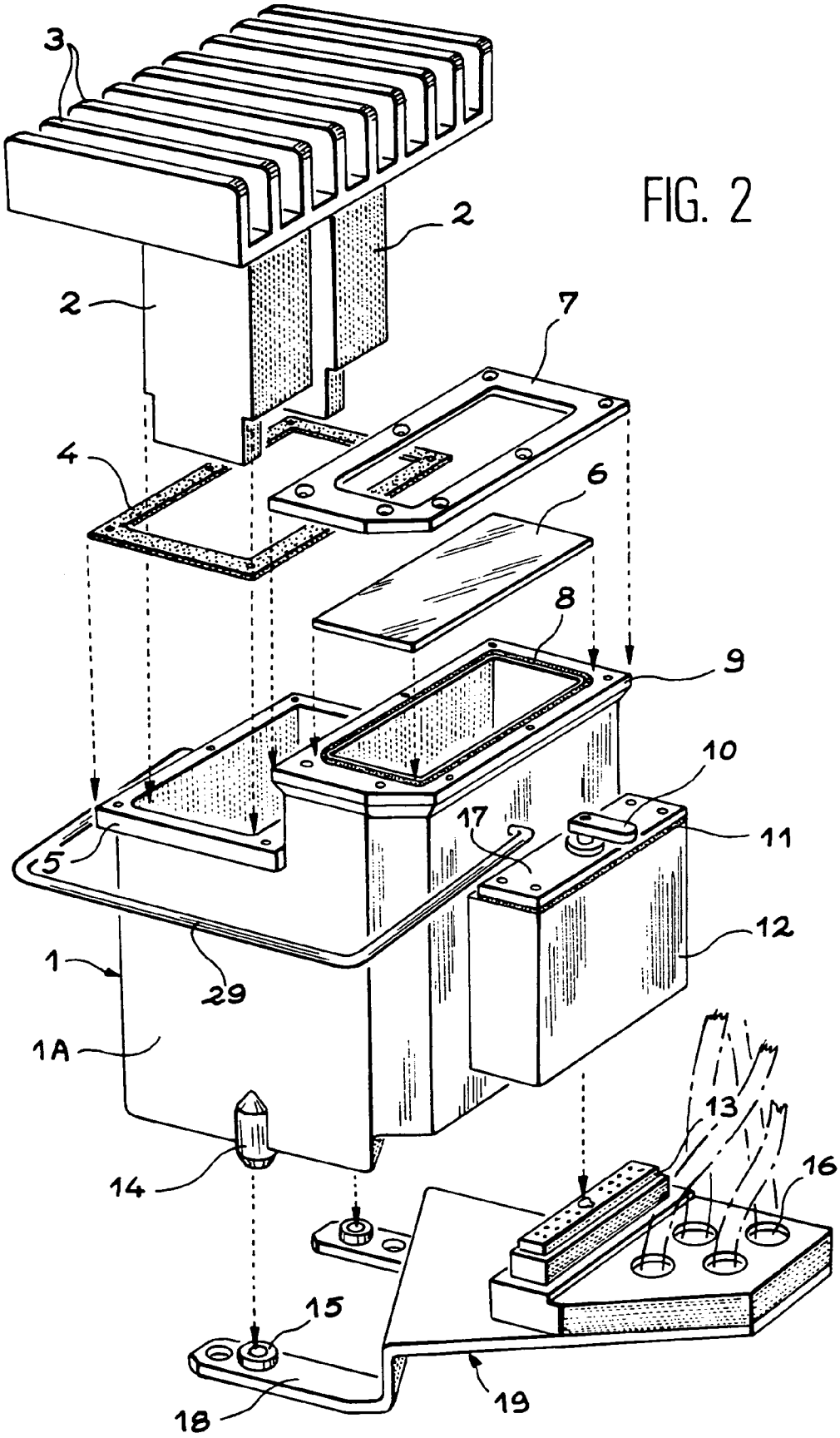
FIG. 2, showing an exploded view of the power supply box for the control system according to the invention.

With reference to FIG. 2, the power supply box 1 is also removable and transportable and is provided with a handle 29 like the control box 20. It is used with a base 19 that is fitted with a connection strip 13. Holes 16 are formed on it on the same side, that are used for crossings for the various electricity power supply cables in liaison with this power supply box 1, through connectors. Finally, the base 19 has two attachment lugs 18 each equipped with at least one attachment hole 15 in which a centering pin 14 of the power supply box 1 is positioned.

This power supply box is in the form of a housing 1A preferably made of stainless steel. This housing mainly contains two power supply boards 2 located inside it and fixed near the top to a ribbed heat sink 3. This assembly is fixed onto housing 1A, particularly onto a first flange 5, through a gasket 4. A second top part of the housing 20A is closed by a Plexiglas plate 6 placed onto a second top flange 9 by means of an attachment flange 7. The assembly is completed by a gasket 8. Finally, as for the control box 1A, the power supply box 1 is fitted with a side part 12 containing means of locking this power supply box 1 onto its base 19. An operating lever 10 is located on the top part of this side part 12 that is closed by a flange 17 and a gasket 11.

Figure 3:
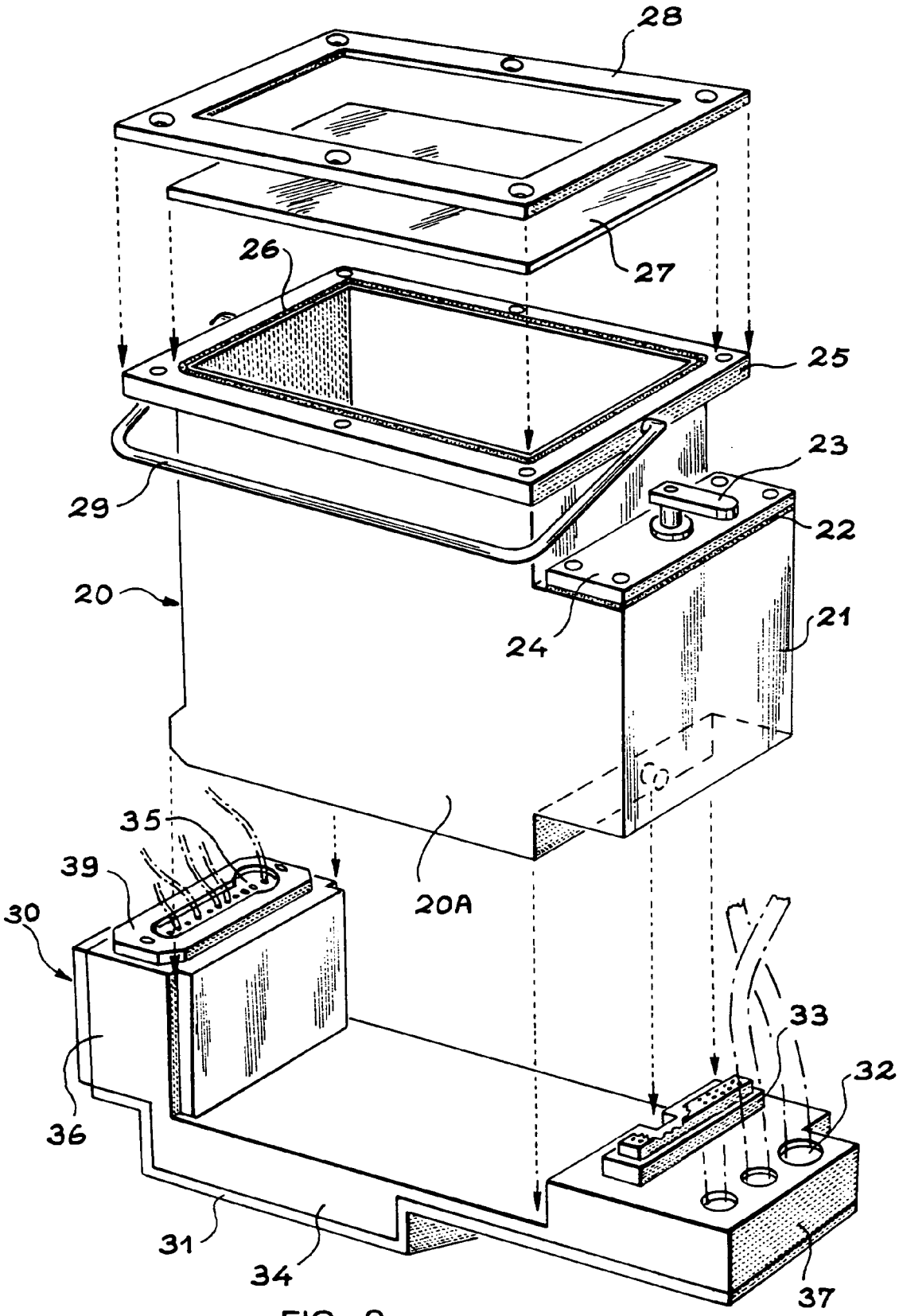
FIG. 3, showing an exploded view of the control box of the system according to the invention.

With reference to FIG. 3, the control box 20, which is an onboard data processing box, consists of a removable housing 20A that can be transported using a manipulation handle 29 fixed on its upper part, and a base 30 permanently fixed on an equipment to be controlled.

The base 30 consists mainly of a base plate 34, the shape of the top part matching the bottom part of box 20A, so that this box can be received and put into position. The base 30 also includes a lead base plate 31 located below the base plate 34. The purpose of this lead base plate 31 is to prevent radiation emanating from the equipment to be manipulated below the base 30 from damaging or radiating elements in the control box 20 and its contents, namely the printed circuit boards.

The base 30, and particularly the base plate 34, also includes a fairly voluminous front head 36, and a back head 37 that is not quite as large, in other words is slightly flatter. Note that the front head 36 and the back head 37 are located on each side of the housing 20A of the control box 20 itself, the base 30 and its lead base plate 31 being slightly larger, in other words projecting beyond the side of the control box 20. The front head 36 comprises means for the external connection of the various control cables to be used by the remote manipulator or the equipment to be controlled by the control box 20. Thus, a connection strip 35 is placed on the front head 36 using an attachment flange 39. For the back head 37, connection holes 32 are provided to connect cables to the equipment.

There is also a connection strip 33 on the back head 37, forming internal connection means between the base 30 and the control cabinet 20.

Note that these different internal or external connection means are used for recognition of the base 30 when a control cabinet 20 needs to be put into position on a remote manipulation equipment to be controlled and with this type of base 30. In other words, each remote manipulator or remote manipulation equipment is characterized by its base and particularly by internal means, and particularly by the connection strip 33.

Preferably, the control box is made of stainless steel and is open at the top, while the top of the control box 20 is closed by a Plexiglas plate 27. This assembly is completed by a flange 28 and a gasket 26. Therefore, the assembly is placed on a main flange 25 of the control box 20. The box 20 is placed on the base 30.

Note the presence on this base of a locking handle 23 placed on a locking housing 21 itself located on the side of the control box 20. This assembly is completed by a housing flange 24 and a housing flange gasket 22. It is thus easy to understand that once a control box 20 is put into place on its base 30, it can be fixed by locking using the locking handle 23.

Finally with reference to FIG. 1, several control boxes may be necessary for some equipment to be controlled such as complex manipulators. These other boxes are not modified physically, but some boards have been removed from inside them. The old boxes will be replaced by new boxes in exactly the same positions equipped with their corresponding bases.

The invention claimed is:

1. Control system for remote manipulation equipment (41) fixed on carrying equipment (43) operating in a confinement containment (40) and subjected to radioactive radiation comprising:

"onboard" control means located inside the containment (40) designed to control movements of the manipulation and carrying equipment (41, 43); and management means (42) located outside the containment (40) providing the interface between the operator and the control means, characterized in that:

the control means comprise firstly at least one a control box (20) comprising electronic circuit boards, and secondly a power supply box (1) comprising at least one energy supply source, a lead base plate (31) configured to shield the electronic circuit boards of each control box (20) from radiation, the management means (42) comprises communication device to transmit orders to/the onboard control means and to receive data about the state of the control means and the state of remote manipulation and carrying equipment (41, 43), and wherein the control means is provided with a base (19, 30), larger than the power supply box (1) and the control box (20), fixed permanently on each equipment to be controlled and each being provided with:

means of attachment to a control box (20) or a power supply box (1) onto its base, internal connection means to make electrical and/or electronic connections between each box and the base on which the box is fixed, and external connection means for making external electrical and/or electronic connections between the equipment (41, 43) to be controlled and the base (30), and a plurality of supply boxes and a plurality of control boxes wherein the power supply boxes (1) and the control boxes (20) are provided with locking means (10, 12, 21, 23) on their corresponding bases (19, 30, 44), that can be manoeuvred from outside these power supply boxes (1) and control boxes (20).

2. Control system according to claim 1, characterized in that the electronic circuit boards comprise several microprocessors configured to operate alternately and processing configured to provide functional control over the microprocessors.

3. Control system according to claim 1, characterized in that the control system is self-configurable to match the manipulation equipment (41) and the carrying equipment (43).

4. System according to claim 1, characterized in that the control means (42) comprise circuits for processing status data received from the control means to diagnose failures and operating errors of the equipment (41, 43) and the control means.

5. System according to claim 1, characterized in that the power supply boxes (1) and the control boxes (20) each comprise a stainless steel housing closed by a Plexiglas cover (6, 27).

6. System according to claim 5, characterized in that each control box comprises gaskets (8, 26) to be used for assembly of the Plexiglas covers (6, 27).

7. System according to claim 1, wherein each control box (20) and each power supply box (1) is configured to be removably attached to the carrying equipment (43), wherein the carrying equipment (43) is configured to support the control box (20) and the power supply box (1) when the control box (20) and power supply box (1) are attached to the carrying equipment (43).

8. System according to claim 1, wherein each control box (20) includes a housing (20A) and is configured to be attached to the carrying equipment (43), wherein the lead base plate (31) is configured to be placed between the housing (20A) and the carrying equipment (43) when the control box (20) is attached to the carrying equipment (43).

9. System according to claim 8, wherein each control box (20) further includes a base (30) configured to be permanently attached to the carrying equipment (43) and the housing (20A) is configured to be removably attached to its base (30), wherein the base (30) includes the lead base plate (31).

* * * * *